US005706566A

United States Patent [19]

Igarashi

[11] Patent Number: 5,706,566

[45] Date of Patent: Jan. 13, 1998

[54] HIGH OUTPUT METHOD FOR FABRICATING METAL WOOD GOLF CLUB HEADS

[76] Inventor: Lawrence Y. Igarashi, 30231 Tomas Rd., Rancho Santa Margarita, Calif. 92688

[21] Appl. No.: 406,071

[22] Filed: Mar. 17, 1995

Related U.S. Application Data

[63] Continuation-in-part of Ser. No. 255,263, Jun. 7, 1994, Pat. No. 5,518,240.

[51] Int. Cl.[6] ..... B23P 17/00

[52] U.S. Cl. ..... 29/527.5; 29/463; 29/527.6; 228/125; 228/196

[58] Field of Search ..... 29/463, 527.5, 29/527.6; 164/76.1; 228/125, 196; 264/232, 237, 348

[56] References Cited

U.S. PATENT DOCUMENTS

| | | | |
|---|---|---|---|
| 1,347,367 | 7/1920 | Gerbaud | 164/76.1 |
| 2,466,562 | 4/1949 | Steinberger | 29/463 X |
| 3,486,938 | 12/1969 | Dubitsky | 164/76.1 X |
| 4,021,047 | 5/1977 | Mader | 273/167 H |
| 4,313,607 | 2/1982 | Thompson | 273/171 |
| 4,438,931 | 3/1984 | Motomiya | 273/80.2 |
| 4,465,221 | 8/1984 | Schmdit | 273/173 |
| 5,028,049 | 7/1991 | McKeighen | 273/167 H |
| 5,106,094 | 4/1992 | Desbiolles | 273/167 H |
| 5,232,224 | 8/1993 | Zeider | 273/167 H |
| 5,294,037 | 3/1994 | Schmidt | 228/125 |
| 5,346,217 | 9/1994 | Tsuchiya | 273/167 H |

FOREIGN PATENT DOCUMENTS

| | | | |
|---|---|---|---|
| 6170019 | 6/1994 | Japan | 164/76.1 |
| 562379 | 6/1977 | Russian Federation | 164/76.1 |
| 2212425 | 7/1989 | United Kingdom | 164/76.1 |

OTHER PUBLICATIONS

Yamaha article in the Jun. 1994 issue of Golf Classic printed in Tokyo, Japan, pp. 74 and 75.

*Primary Examiner*—Joseph M. Gorski
*Attorney, Agent, or Firm*—Larry K. Roberts

[57] ABSTRACT

A method of fabricating a metal wood club head. The head is fabricated in two half-sections, each formed by a casting technique. Increased production throughput is achieved by the use of forming dies to maintain the shape of the two half-sections after removal from the casting molds, before the head half-section elements have fully hardened to a solid state. The two half-sections are subsequently joined by welding together facing edges of the respective half-sections along a parting line. The parting line extends through the highest point in the head crown, generally parallel to the face region and behind the hose. The placement of the parting line permits the use of simple one-piece mold cores, since there are no negative angles within the half-section elements to prevent such a core from being removed. The method is low cost, and provides a high strength club head, with the weld joint located away from club stress points.

12 Claims, 8 Drawing Sheets

FIG. 1
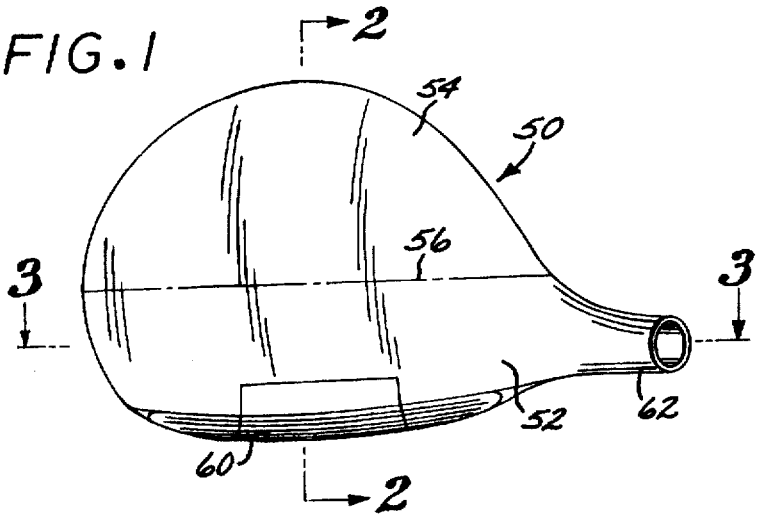
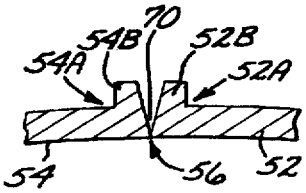
FIG. 4
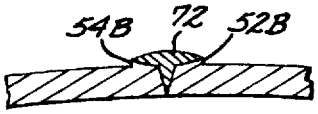
FIG. 5
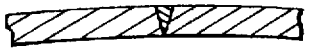
FIG. 6
FIG. 2
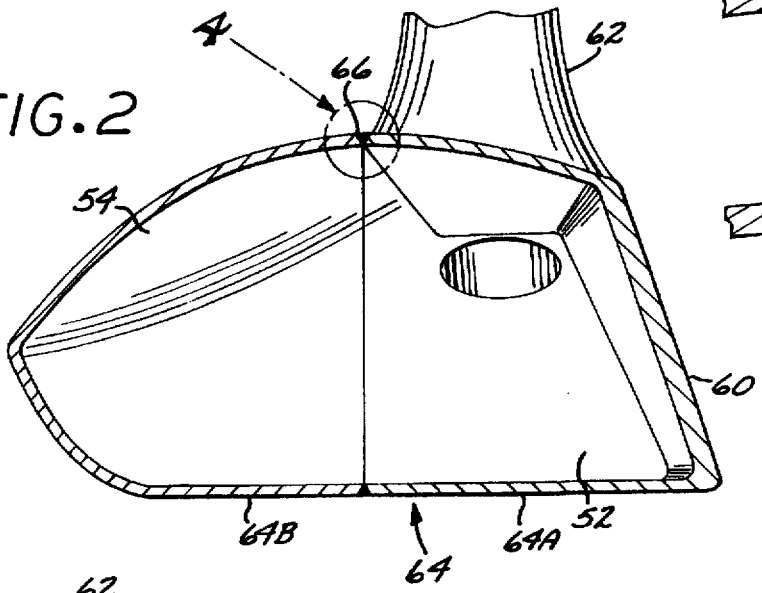
FIG. 3
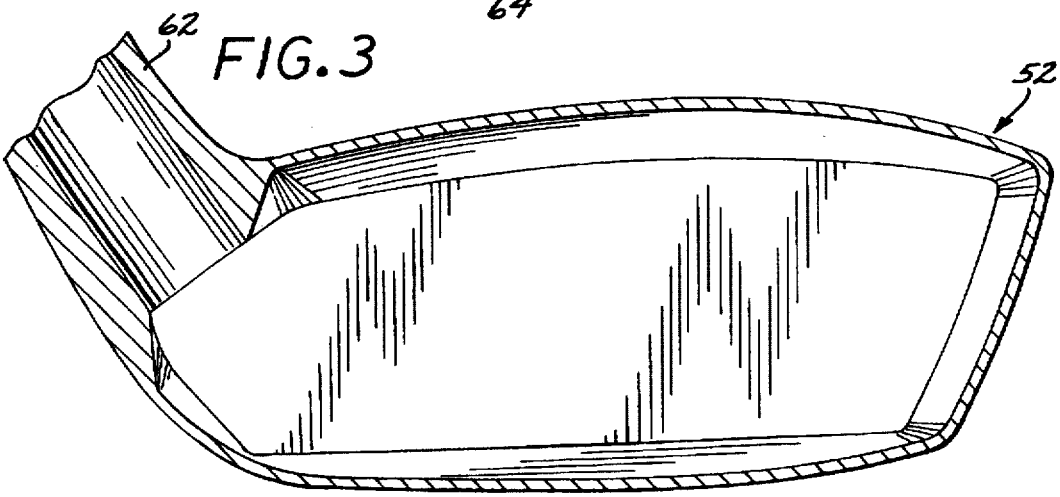

FIG. 7
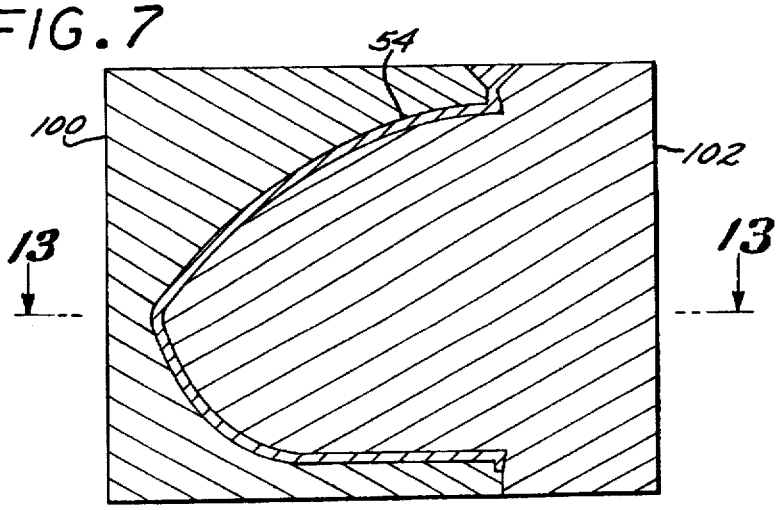
FIG. 8
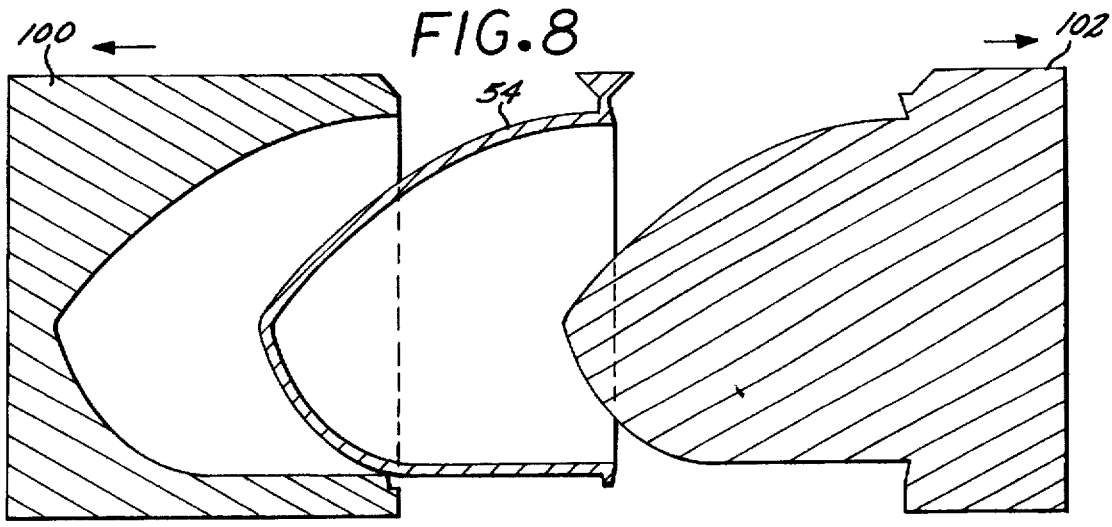
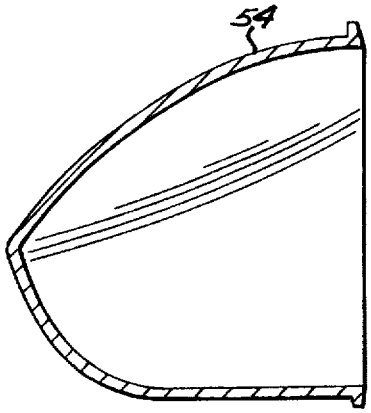
FIG. 9

HIGH OUTPUT METHOD FOR FABRICATING METAL WOOD GOLF CLUB HEADS

This is a continuation-in-part of application Ser. No. 08/255,263, filed Jun. 7, 1994 and now U.S. Pat. No. 5,518,240.

TECHNICAL FIELD OF THE INVENTION

This invention relates to the field of golf clubs, and more particularly to a method for fabricating metal wood club heads from castings.

BACKGROUND OF THE INVENTION

In recent years, golf wood club heads are fabricated from metal, typically hollow metal heads of a thin shell construction. Exemplary of these are the oversized drivers, fabricated from metals such as stainless steel, aluminum and titanium. Thus, "wood" club heads refer to the class of golf clubs including the driver, typically known as the number one wood, and the fairway woods, typically the number three, four, five and seven woods. The ball-impacting face of the number one wood typically is inclined from the vertical in the range of 7½ to 12 degrees, while the faces of the fairway woods have a greater inclination, e.g., 13–17 degrees for the number three wood, 20 degrees or so for the number four wood, 23 degrees for the number five wood, and 27 degrees for the number seven wood.

The fabrication of hollow metal wood heads has presented difficulties in achieving high quality parts at reasonable cost. There are several conventional fabrication techniques.

In one fabrication technique, a one piece body structure which does not include the sole plate is made by casting. Because the head body tapers from the center of the head to a smaller sole region footprint where the sole plate opening is located, a multipiece collapsible mold core must be used to cast the body structure. The different pieces of the collapsible interior mold core are then removed through the sole plate opening, and the sole plate is attached to the body structure by conventional techniques, typically welding. Multipiece collapsible mold cores are very expensive, and the set up and removal of the core is time consuming. Moreover, the core pieces can become loose due to mishandling and wear, and this can lead to out-of-tolerance club head wall thicknesses. It is quite difficult to obtain repeatable accuracy using the multipiece core molds, there are problems with the accuracy of sole-plate welding onto the head body, and therefore the yield is low.

Another fabrication technique is to fabricate the club body structure with an integral sole, to which a separate face plate is attached. A face plate opening is provided, through which interior mold core elements are removed after the body structure has been molded. The face plate is then attached to the club head body. While this technique facilitates the molding process, in that multipiece cores having fewer interior core elements may be required than are required for the technique employing interior collapsible cores removed through a sole opening, it suffers the disadvantage of imposing design constraints. The face plate opening must be designed to provide a receiving structure for the face plate, typically a recessed shoulder structure, so that the face plate can withstand the impact stress. Moreover, the face plate is typically attached by welding, and any imperfections in the quality of the welds can lead to failure or performance degradation, since the face is the only part of the wood club head that directly contacts the golf ball.

Accordingly, it would be an advance in the art to have a technique for fabricating hollow metal driver heads, without the need for expensive multipiece mold cores, and which enabled the face plate to be fabricated as an integral part of the club head body structure.

SUMMARY OF THE INVENTION

A method is disclosed for fabricating a hollow golf club head, comprising a sequence of the following steps:

(i) casting in casting mold apparatus from a molten material first and second separate club head sections, said front section defining a first portion of said hollow club head including a club face region, hosel region, a front portion of a sole region and a front portion of a head crown region, said rear section defining a rear portion of said hollow club head including a rear portion of said head crown region, a rear portion of said club head and a rear portion of said sole region, said club head being defined by said front and rear club head sections;

(ii) removing said first and second separate club head sections from said casting apparatus before said molten material has fully set in a nondeformable solid state;

(iii) placing said first and second club head sections on respective first and second forming dies, said forming dies having forming surfaces which match corresponding surfaces of said casting apparatus to maintain said first and second club head sections in a shape and size determined by said casting apparatus surfaces;

(iv) permitting said material to set in a solid state;

(v) removing said first and second club head sections from said first and second forming dies; and (vi) joining said front and rear club head sections together along a seam formed by adjacent edges of said head sections to form said hollow club head.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a top view of a metal wood golf club head constructed in accordance with the invention.

FIG. 2 is a cross-sectional view taken along line 2—2 of FIG. 1.

FIG. 3 is a cross-sectional view taken along line 3—3 of FIG. 1.

FIG. 4 is an enlargement of the area indicated in the phantom circle of FIG. 2, prior to the two halves of the club head being joined together.

FIG. 5 shows the same area as FIG. 4, after the two club head halves have been welded together.

FIG. 6 shows the same area as FIG. 5, after the weld bead has been ground away.

FIG. 7 is a cross-sectional view taken through the molds for forming the rear half-section of the golf club head of FIG. 1, after the section has been cast.

FIG. 8 shows the removal of the head half-section from the mold of FIG. 7.

FIG. 9 is a cross-sectional view of the club half-head section fabricated as shown in FIGS. 7 and 8.

taken along a line transverse to the seam at which the front and rear half-sections are joined together.

Figure 10:
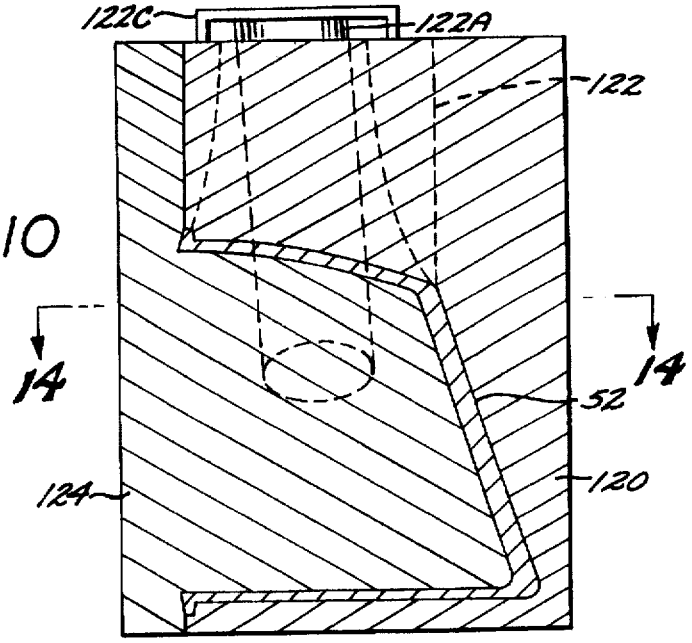
FIG. 10 is a cross-sectional view taken through the molds for forming the front half-section of the golf club of FIG. 1.
Figure 11:
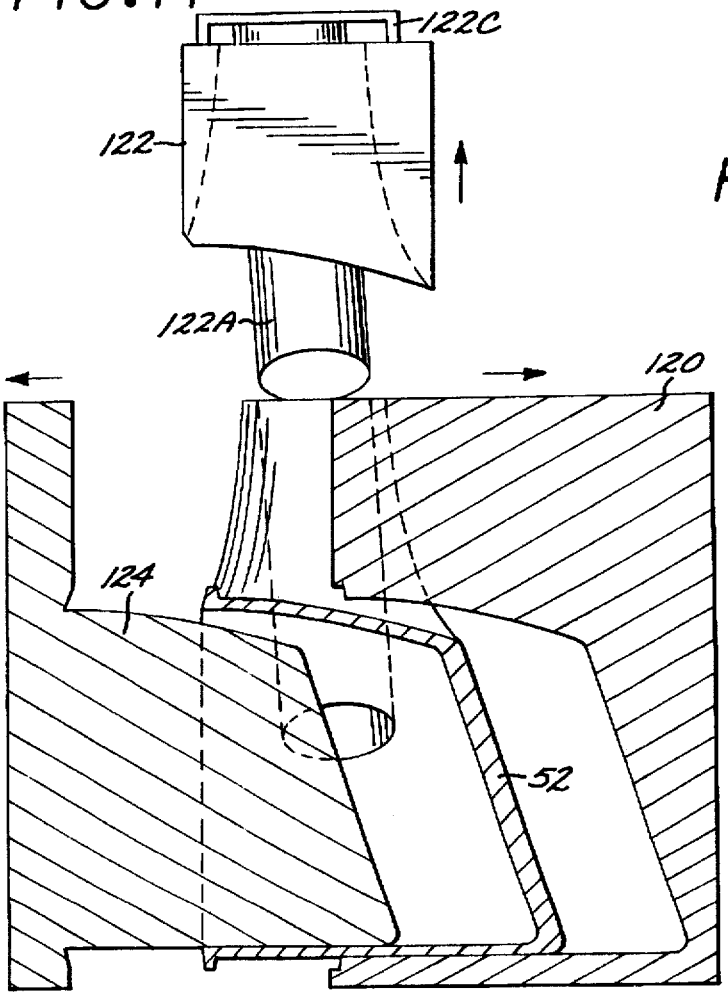

FIG. 11 shows the removal of the molds of FIG. 10 after completion of the casting process.

Figure 12:
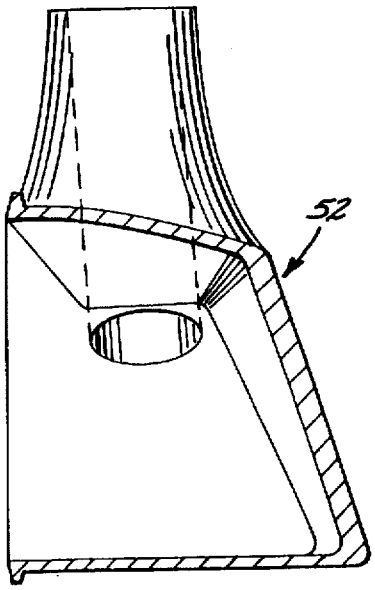

FIG. 12 shows the finished front half-section of the golf club head of FIG. 1.

Figure 13:
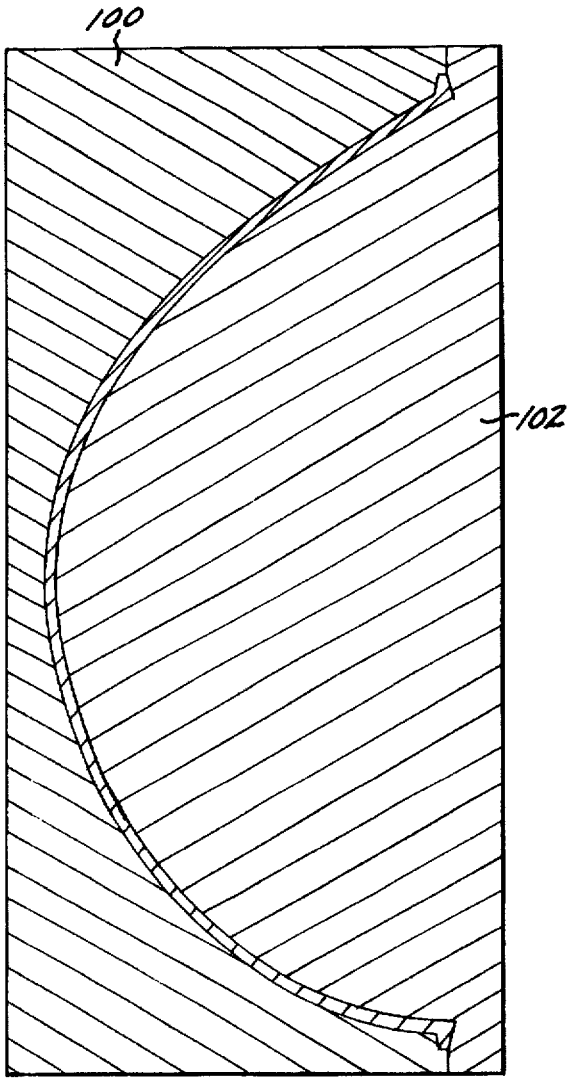

FIG. 13 is a cross-sectional view of the molds and rear half-section of FIG. 7, taken along line 13—13 of FIG. 7.

Figure 14:
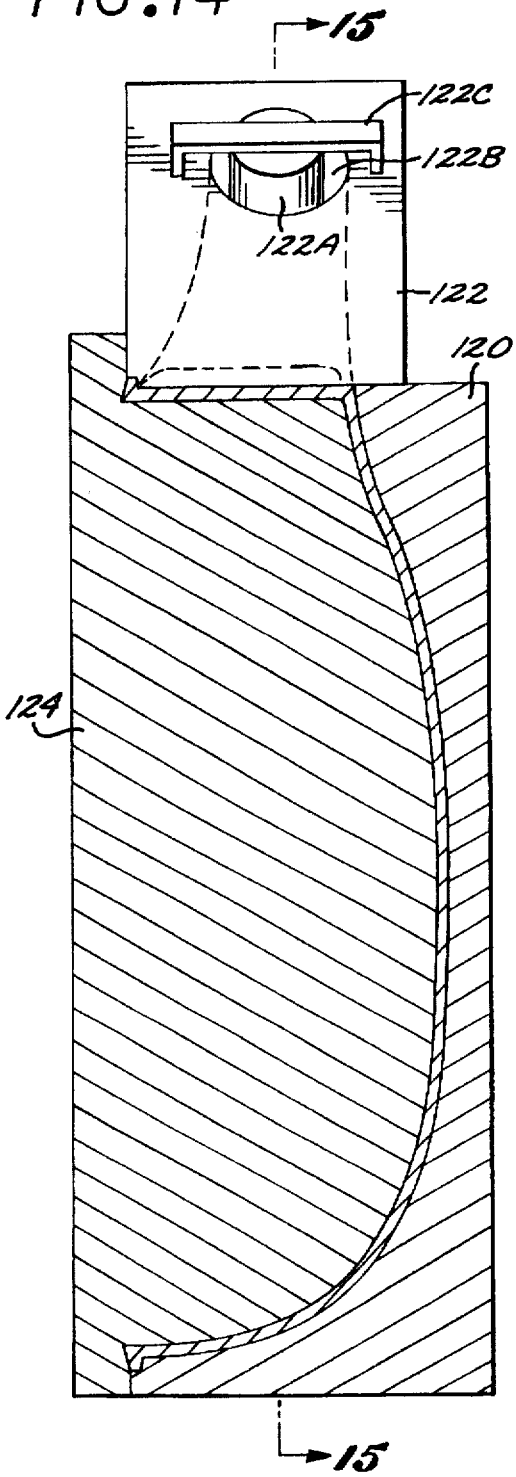

FIG. 14 is a cross-sectional view of the molds and front half-section of FIG. 10, taken along line 14—14 of FIG. 10.

Figure 15:
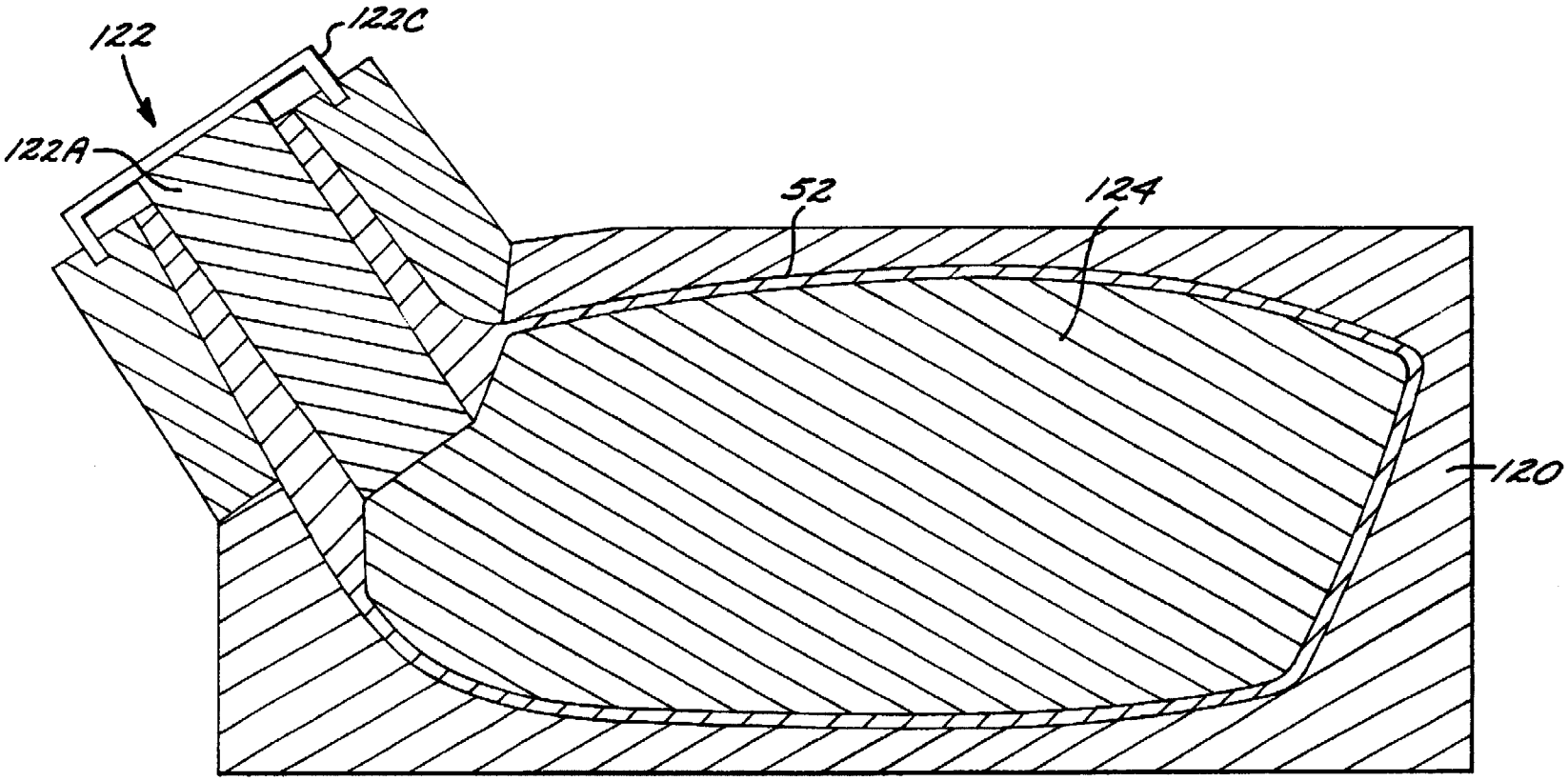

FIG. 15 is a cross-sectional view taken along line 15—15 of FIG. 14.

Figure 16:
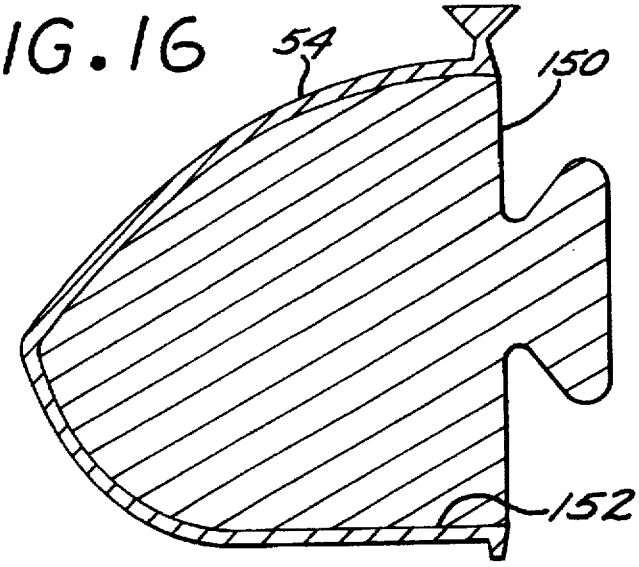

FIG. 16 is a cross-sectional view of a forming die useful for maintaining the shape of the rear club head section while it cools down after casting in and removal from the casting molds.

Figure 17:
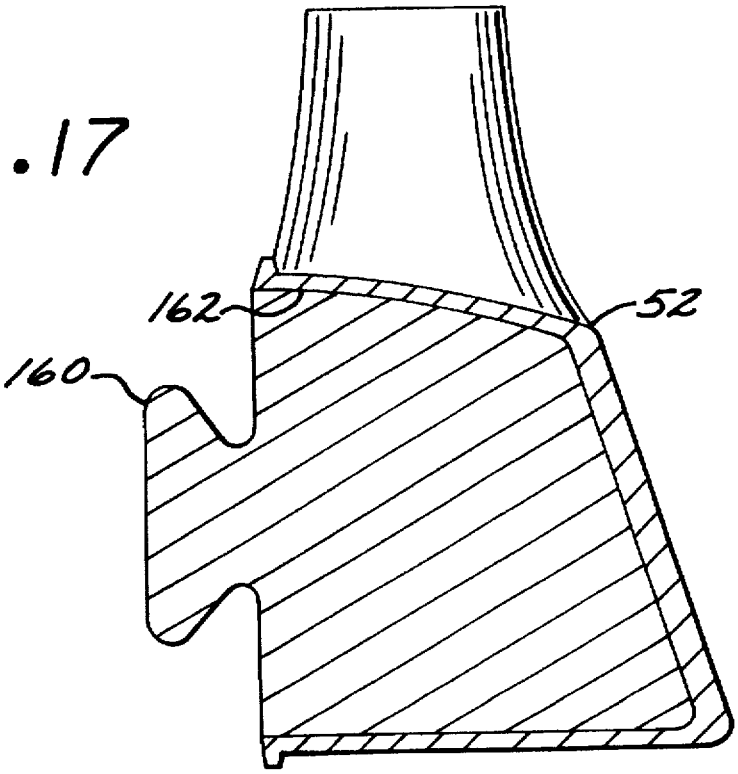

FIG. 17 is a cross-sectional view of a forming die useful for maintaining the shape of the front club head section while it cools down after casting in and removal from the casting molds.

Figure 18:
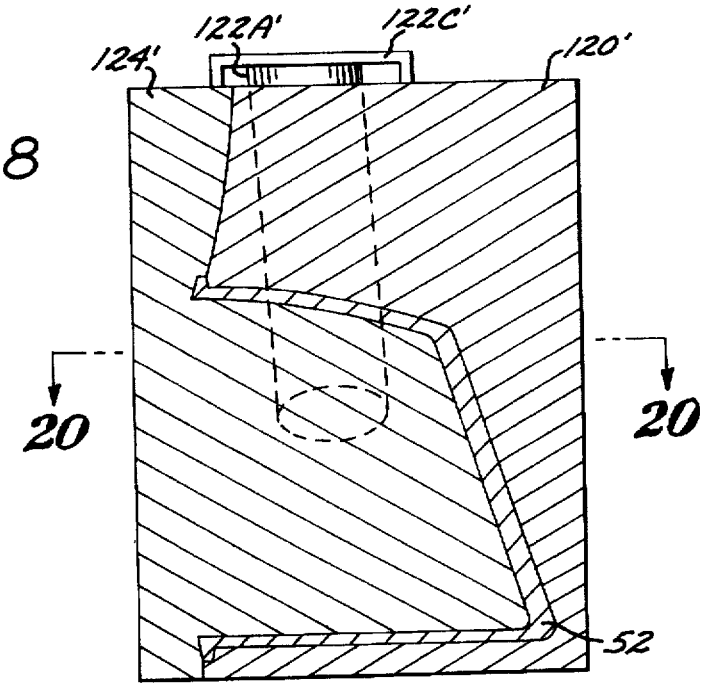

FIG. 18 is a cross-sectional view taken through an alternate embodiment of a casting mold set for casting the front club head section.

Figure 19:
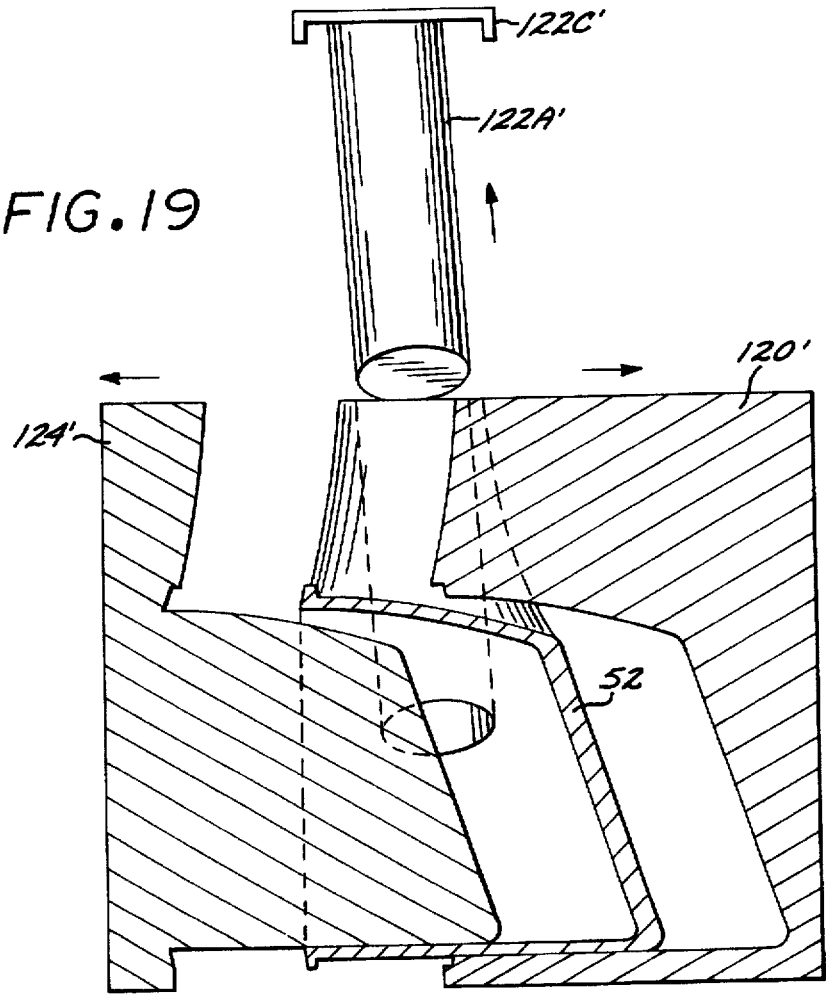

FIG. 19 is an exploded cross-sectional view of the casting mold set of FIG. 18, illustrating removal of the front head section from the mold sections.

Figure 20:
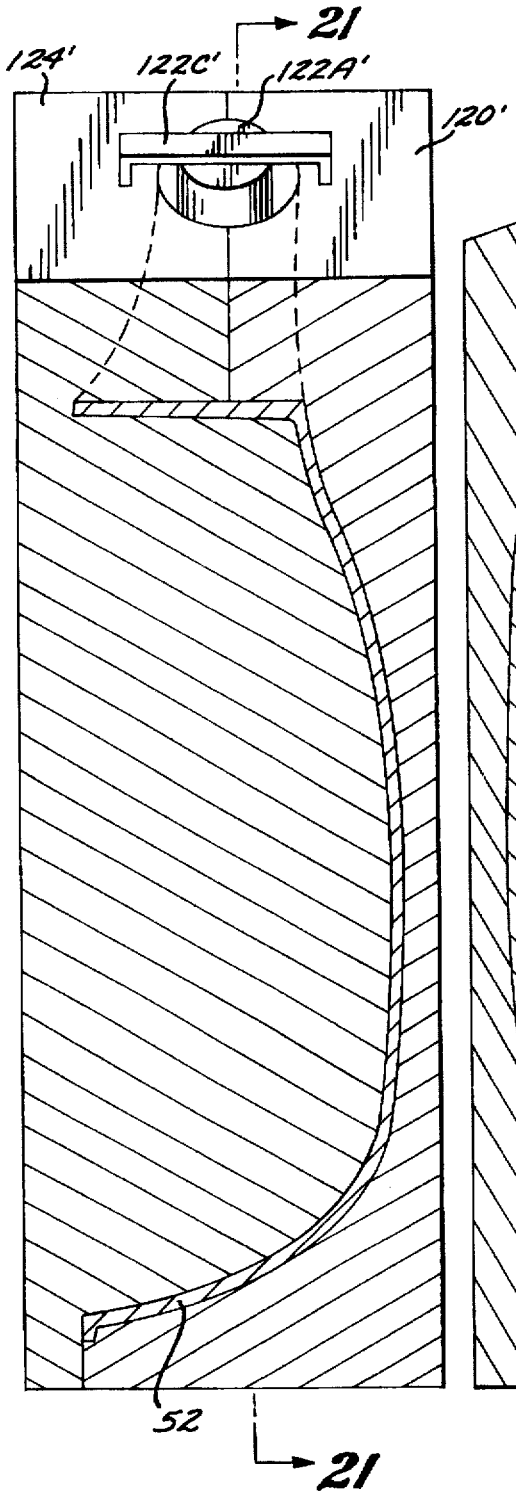

FIG. 20 is a cross-sectional view of the casting mold set of FIG. 18, taken along line 20—20 of FIG. 18.

Figure 21:
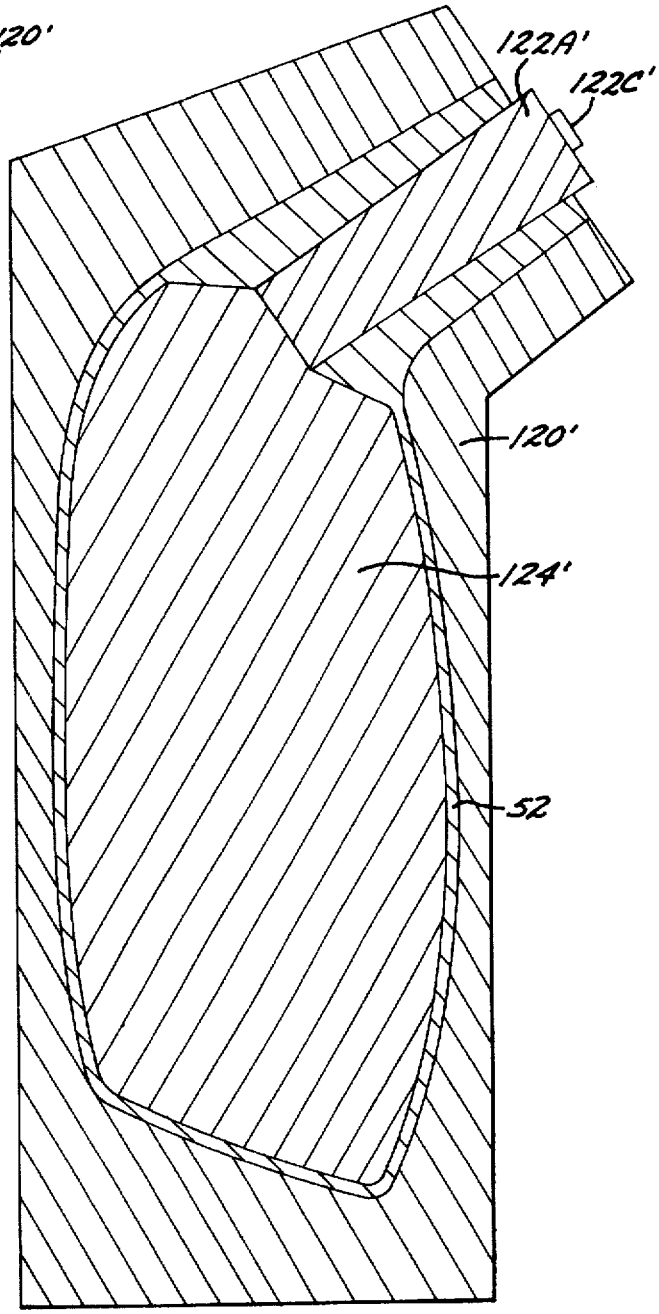

FIG. 21 is a cross-sectional view of the alternate casting mold set, taken along line 21—21 of FIG. 20.

DETAILED DESCRIPTION OF THE PREFERRED EMBODIMENTS

A golf metal wood driver 50 constructed in accordance with this invention is fabricated from two cast half sections 52 and 54, which are joined together along a seam 56 which extends generally parallel to the club face 60 and behind the hose 62, running along the highest part of the crown on the top of the head, along behind the hosel region, down the sides of the head and transversely along the sole region of the club head. The section element 52 is the front section of the club head, in that it defines the face region 60 and hosel 62 of the head, and as well the front portion 64A of the sole region 64. The section element 54 is the rear section of the club head, in that it defines the rear portion of the club head from the crown 66 of the club head rearwardly, and the rear portion 64B of the sole 64.

The two club head sections 52 and 54 when joined together define the hollow metal wood club head, including the face region 60, the hosel 62 and sole region 64.

The placement of the seam 56 is selected so that the interior angles formed within each head half section permit fabrication of the half section by use of a single removable simple interior mold core element. That is, the interior angles defined by the walls of the head sections 52 and 54 do not exceed ninety degrees, so that the walls of the half section do not capture the interior mold core element used in the casting process to prevent removal thereof upon completion of the mold process. As a result, the need for complex multi-piece interior mold cores, such as are required to fabricate heads having a separate sole plate, is eliminated. What is more, club heads fabricated in accordance with this process are much stronger than the cast club heads fabricated with a shell and separate face plate, since there is one piece construction at the stress zones around the face region and hosel. As a result, cracking and other like failures at the stress zones are substantially reduced.

This invention can be utilized with all types of casting methods, including die casting, investment casting, and the like. The preferred club head material used to cast the two sections 52 and 54 is a metal which can be welded along the seam 56 to join the two sections together into an integral club head. Metals useful for the purpose include stainless steel, aluminum, titanium and their alloys.

FIGS. 4–6 illustrate a preferred technique for constructing the mating edges of the two head sections 52 and 54 to facilitate the welding process. At edges 52A and 54A of the sections, ridges 52B and 54B are formed therein, so that when the two sections 52 and 54 are joined together, a channel 64 is defined. The seam is welded, with the ridges serving to facilitate holding the weld bead 72, as shown in FIG. 5. After completion of the weld operation, the ridges 52B and 54B and the bead 70 are ground off, leaving the seam flush with the exterior surface of the adjacent areas of the club head body, as shown in FIG. 6. A preferred material for the club head sections is titanium alloy TI 6-4, which can be welded in an argon atmosphere. A preferred welding technique is fuse-welding, wherein the ridges 52B and 54B are melted to fill in the weld seam, instead of melting expensive filler rods to fill the joint.

The use of fuse-welding provides a significant cost advantage, since the cost of the filler rods is avoided. In a particular titanium alloy fuse-welding example, the ridges 52B and 54B can be fabricated to provide an angled surface which is at 15 to 20 degrees from the vertical, so that the channel 70 is formed by surfaces which meet to define an included angle in the range of 30 to 40 degrees. Other angles may also be suitable.

FIGS. 7–15 illustrate the method of casting the front and rear club head sections 52 and 54 in further detail. FIGS. 7–9 and 13 show the fabrication of the rear section 54. FIGS. 10–12, 14 and 15 show the fabrication of the front section 52.

Turning now to FIGS. 7–10 and 13, the rear section 54 in this embodiment is fabricated by a casting process using an exterior mold 100 and a one piece interior mold core 102. With the two mold element in position to define the mold cavity for the head section 54, molten material, such as molten metal, is poured or injected into the mold cavity, and permitted to cool and solidify. This step in the operation is shown in FIG. 7, and in FIG. 13. After the molten material has cooled, the mold elements 100 and 102 are separated, as shown in FIG. 8, to provide the rough cast part, which upon removal of flashing results in the half section 54, as shown in FIG. 9.

The fabrication of the front head section 52 is illustrated in FIGS. 10–12, 14 and 15. The front section 52, in this exemplary embodiment, is fabricated in a casting process using three mold elements 120, 122 and 124 to define the cavity for the section 52. The exterior mold element 120 fits together with the hosel mold element 122 and the interior mold core 124 to define the cavity for head section 52. The hosel mold element 122 includes a pin 122A suspended within a cylindrical opening 122B (FIG. 14) to define the opening for receiving the club shaft (not shown). FIGS. 10, 14 and 15 show the mold elements in position to define the mold cavity. Molten material is then poured or injected into the mold cavity, and permitted to cool and harden. Thereafter, the three mold elements 120, 122 and 124 are separated, as shown in FIG. 11, to provide the club head front section 52 (FIG. 12). The one piece, removable configuration of the interior mold core 124 is clearly shown.

To increase throughput capacity of the fabrication method illustrated in FIGS. 1—15, forming dies may be used to maintain the shape of the club head sections after removal from the casting molds. The edges of the head sections which are to be joined can be quite thin, e.g., on the order of 0.010 inch to 0.040 inch, for large oversize heads. If the head sections are removed from the casting molds while the metal has not cooled and is still deformable, the edges may deform from the desired shape of the production mold core. Yet to wait until the parts have cooled to the point that the edges are not deformable will substantially slow down production throughput for a given set of production molds.

In accordance with a further aspect of the invention, forming dies 150 (FIG. 16) and 160 (FIG. 17) have respective forming surfaces 152 and 162 which contact the head sections 54 and 52, respectively, which are the same shape and size as corresponding surfaces of the production casting molds 102 and 124, respectively. Once the club head sections 52 and 54 are cast in the production molds, they can be quickly removed prior to fully cooling down and placed over the forming dies 160 and 150, respectively, to maintain the shape of the edges of the head section elements until the metal has cooled down sufficiently that the edges are no longer deformable. The forming dies preserve exactly the desired shape of the club head edges. The sections 52 and 54 can then be joined together in the manner described above.

Once the club head sections 52 and 54 are removed from the production casting molds and the forming dies are inserted into position in the hollow head sections, the production molds can then be setup for casting another set of club head sections. Because the length of each casting cycle can be shortened as a result of the use of the forming die, the production throughput for a given set of casting molds can be substantially increased. Depending on the club head configuration and material composition, several sets of forming dies may be used for each set of production casting molds.

In an exemplary embodiment, the forming dies 150 and 160 are fabricated from aluminum. By use of computer controlled machines to machine both the production molds and the forming dies to the same specifications, identity in the respective configurations of the forming dies and the production molds can readily be achieved.

FIGS. 18–21 illustrate an alternate configuration of the casting molds for casting the front section 52 of the club head section. The mold 120' has integrated therein the hosel defining features, which were defined by the mold section 122 in the embodiment shown in FIGS. 10 and 11. Only the hosel core pin 122A' is removable, being supported in place during casting by a spider element 122C' which mates with registering surfaces (not shown) in the top of the mold section 120'. After casting the head section 52, with the mold sections 120' and 124' in place with the hosel core pin 122A' as shown in FIGS. 20 and 21, the mold section 124' and the core pin 122A' are withdrawn, and the element 52 can be removed from mold element 120'.

It is understood that the above-described embodiments are merely illustrative of the possible specific embodiments which may represent principles of the present invention.

Other arrangements may readily be devised in accordance with these principles by those skilled in the art without departing from the scope and spirit of the invention.

What is claimed is:

1. A method for fabricating a hollow golf club head, comprising a sequence of the following steps:

(i) casting in casting mold apparatus from a molten material first and second separate club head sections, said first section defining a first portion of said hollow club head including a club face region, hosel region, a front portion of a sole region and a front portion of a head crown region, said second section defining a rear portion of said hollow club head including a rear portion of said head crown region, a rear portion of said club head and a rear portion of said sole region, said club head being defined by said first and second club head sections;

(ii) removing said first and second separate club head sections from said casting apparatus before said molten material has fully set in a nondeformable solid state;

(iii) placing said first and second club head sections on respective first and second forming dies, said forming dies having forming surfaces which match corresponding surfaces of said casting apparatus, thereby maintaining said first and second club head sections in a shape and size determined by said casting apparatus surfaces;

(iv) causing said material to set in a solid state;

(v) removing said first and second club head sections from said first and second forming dies; and (vi) joining said first and second club head sections together along a seam formed by adjacent edges of said head sections.

2. The method of claim 1 wherein said step of joining said first and second club head sections includes welding said first and second club head sections together along said seam.

3. The method of claim 2 wherein said front and rear head sections include respective front and rear edge ridge elements extending along said adjacent edges of said sections, said front and rear edge ridge elements tapering to an area of reduced thickness at said respective edges, and wherein said ridge elements cooperate to define a channel along said seam when said adjacent edges of said front and rear head sections are positioned together, said channel for receiving melted material during said welding of said first and second club head sections.

4. The method of claim 3 wherein said step of welding comprises fuse-welding said respective edges together, which fuse-welding includes melting said ridge elements, thereby providing melted material, receiving said melted material in said channel, and then causing said melted material to solidify into a weld bead.

5. The method of claim 4 wherein said step of joining said first and second club head sections further includes grinding said weld bead flush with adjacent surfaces of said first and second club head sections at said seam.

6. The method of claim 1 wherein said step of casting said second head section includes:

providing an exterior mold element defining a first cavity surface defining an exterior surface of said second head section;

providing an interior mold core element defining a second cavity surface defining an interior surface of said second head section;

positioning said exterior mold element and said interior mold core element in a closed mold configuration so that said first and second cavity surfaces define a mold cavity for said second head section;

releasing said molten material into said mold cavity and causing the molten material to harden; and withdrawing said exterior mold element and said core element from said hardened material.

7. The method of claim 6 wherein said interior mold core element is a one piece mold element.

8. The method of claim 1 wherein said molten material is a metal selected from the group consisting of stainless steel, aluminum, titanium and alloys thereof.

9. The method of claim 1 wherein said step of casting said first head section includes:

providing an exterior mold element having a first cavity surface to define an exterior surface of said first head section, said exterior mold element including a hosel defining opening to define a hosel region of the club head and a hosel core pin removably fitted within the hosel defining opening;

providing an interior mold core element having a second cavity surface to define an interior surface of said first head section;

assembling said interior mold core element and said exterior mold element together to define a mold cavity for the first head section;

releasing said molten material into said mold cavity and causing said molten material to harden;

removing said hosel core pin, said exterior mold element and said interior mold core element from said hardened material.

10. The method of claim 9 wherein said interior mold core element is a one piece mold element.

11. The method of claim 1 wherein said seam extends along a highest crown point of the club head, along heel and toe regions of the club head and along a sole region of the club head.

12. The method of claim 1, further comprising the step of repeating step (i) thereby casting a second set of club head sections while the first and second club head sections first fabricated are still in place on said first and second forming dies, thereby increasing throughput of said method.

* * * * *